US009399236B2

(12) United States Patent
Perret et al.

(10) Patent No.: US 9,399,236 B2
(45) Date of Patent: Jul. 26, 2016

(54) MACHINE FOR PRINTING ON THREE-DIMENSIONAL ARTICLES AND PRINTING METHOD

(71) Applicants: Jean Luc Perret, Arbent (FR); Jean Pierre Rousselet, Oyonnax (FR)

(72) Inventors: Jean Luc Perret, Arbent (FR); Jean Pierre Rousselet, Oyonnax (FR)

( * ) Notice: Subject to any disclaimer, the term of this patent is extended or adjusted under 35 U.S.C. 154(b) by 199 days.

(21) Appl. No.: 14/371,091

(22) PCT Filed: Jan. 2, 2013

(86) PCT No.: PCT/FR2013/000005
§ 371 (c)(1),
(2) Date: Jul. 8, 2014

(87) PCT Pub. No.: WO2013/107958
PCT Pub. Date: Jul. 25, 2013

(65) Prior Publication Data

US 2015/0004320 A1 Jan. 1, 2015

(30) Foreign Application Priority Data

Jan. 16, 2012 (FR) ..... 12 00126

(51) Int. Cl.

| | |
|---|---|
| ***B41F 17/18*** | (2006.01) |
| ***B41F 17/28*** | (2006.01) |
| ***B41F 17/30*** | (2006.01) |
| ***B05B 13/02*** | (2006.01) |
| ***B41M 1/40*** | (2006.01) |
| ***B41J 3/407*** | (2006.01) |
| ***B05D 1/02*** | (2006.01) |

(52) U.S. Cl.
CPC ..... *B05B 13/0235* (2013.01); *B05D 1/02* (2013.01); *B41F 17/18* (2013.01); *B41F 17/28* (2013.01); *B41F 17/30* (2013.01); *B41J 3/4073* (2013.01); *B41M 1/40* (2013.01); *B41P 2217/62* (2013.01)

(58) Field of Classification Search
CPC ..... B41F 17/002; B41F 17/006; B41F 17/14; B41F 17/18; B41F 17/20; B41F 17/22; B41F 17/28; B41F 17/30; B41J 3/4073; B41M 1/40; B41P 2217/50; B41P 2217/61; B41P 2217/62; B05B 13/0235; B05D 1/02
USPC ..... 101/38.1, 39, 40
See application file for complete search history.

(56) References Cited

FOREIGN PATENT DOCUMENTS

| | | | |
|---|---|---|---|
| BE | 905 380 | | 12/1986 |
| FR | 2 961 127 | A1 | 12/2011 |
| GB | 2 180 195 | A | 3/1987 |
| WO | WO 2004/009360 | A1 | 1/2004 |
| WO | WO 2011/154628 | A1 | 12/2011 |

*Primary Examiner* — Blake A Tankersley
*Assistant Examiner* — Marissa Ferguson Samreth
(74) *Attorney, Agent, or Firm* — Oliff PLC

(57) ABSTRACT

The printing machine includes a support plate provided on its periphery with a plurality of receiving elements for articles rotatably mounted on the support plate, and a device for rotating the support plate in order that two articles, mounted on their associated receiving elements, respectively face two separate printing stations, the printing stations being supported by a single base. The machine further has a device for generating a relative translational movement between the base and the support plate so that patterns are helically printed on the articles during the rotation of the receiving elements.

10 Claims, 4 Drawing Sheets

MACHINE FOR PRINTING ON THREE-DIMENSIONAL ARTICLES AND PRINTING METHOD

TECHNICAL FIELD OF THE INVENTION

The invention relates to a printing machine comprising:

a support plate provided on its periphery with a plurality of receiving elements for articles rotatably mounted on the support plate, means for rotating the support plate in order that two articles, mounted on their associated receiving elements, respectively face two separate printing stations of the machine, a system for rotating the receiving elements.

STATE OF THE ART

Flaks, tubes, pots used for ink jet printing are generally made out of plastic, because they are particularly very cheap, unbreakable, light, and colorable. Flasks can also be made out of glass.

In order to print a color pattern on a plastic article, one preferably starts with subjecting the surface to be printed to a treatment, e.g. a corona, flame, plasma treatment or any suitable surface treatment, in order to provide the surface with a better ink adherence. A white background may then be printed and caused to dry, for example by means of ultraviolet radiations, before printing a pattern thereon by using a four-color printing process (black, magenta, cyan, yellow).

Document WO2004/009360 discloses a printing device provided with a rotating plate equipped on its periphery with receiving elements 2 for articles to be printed. A printing station comprises a plurality of printing heads arranged around the article to be printed. The height of the pattern to be printed is limited according to the size of the printing head. Thus, this machine does not accept any large dimensional variations of the articles, particularly regarding their height.

OBJECT OF THE INVENTION

The object of the invention consists in making a machine allowing to obtain a high printing rate with a good reproducibility, for printing on articles a pattern whose length may be superior to the printing dimensions of the printing heads.

This object is achieved in that the machine comprises a base supporting the two printing stations, means for generating a relative translational movement between the base and the support plate, and for cooperating with the system for rotating so that patterns are helically printed on the articles associated with the two printing stations.

Alternatively, each printing station of the base is supplied with a single color.

According to a particular embodiment, the means for generating the translational movement comprise:

a support base, a system for guiding the translational movement of the support plate, said system for guiding being mounted on the support base, a system for moving the support plate between a position of the support plate proximal to the support base, and a position of the support plate distal to the support base along the system for guiding.

Advantageously, the system for guiding comprises:

at least one guidance rail in the form of an elongate rod fixed to the support base and configured to slide in a complementary member of the support plate, said complementary member comprising a ball bearing system in contact with said rod.

The system for moving can comprise a helical connection, for example implemented by a screw.

Advantageously, the system for rotating the receiving elements comprises a single motor coupled to each receiving element via a single belt.

The invention also relates to a method for printing on three-dimensional articles, implementing a support plate provided on its periphery with a plurality of receiving elements for articles, said method comprising the following steps of:

placing the support plate, and a base provided with first and second printing stations, into a first printing position so that two different articles respectively face the first and second printing stations, rotating the receiving elements, printing, by means of the first and second printing stations, patterns on the associated articles, the step of printing patterns on the articles being helically performed by imparting, during the rotation of the receiving elements, a relative translational movement between the support plate and the base up to a second printing position representative of the end of a printing cycle. Advantageously, the first and second positions are placed at two shifted points along the rotational axes of the articles.

Preferably, once the second printing position is reached, the support plate carries out a rotational movement during which:

a translational movement between the support plate and the base is initiated so as to take up again the relative level between the support plate and the base in the first position, and a single motor rotates all the receiving elements so that they take up again a position, relative to the support plate, identical to that in the first printing position.

The rotational movement of the support plate, the translational movement and the rotational movement of the receiving elements can overlap at least partially over time during the passage from the second printing position to the first printing position after a step of printing patterns.

BRIEF DESCRIPTION OF THE DRAWINGS

Other advantages and features will become more apparent from the following description of particular embodiments of the invention given as non-restrictive examples and represented in the accompanying drawings, in which.

DESCRIPTION OF PREFERRED EMBODIMENTS

Figure 1:
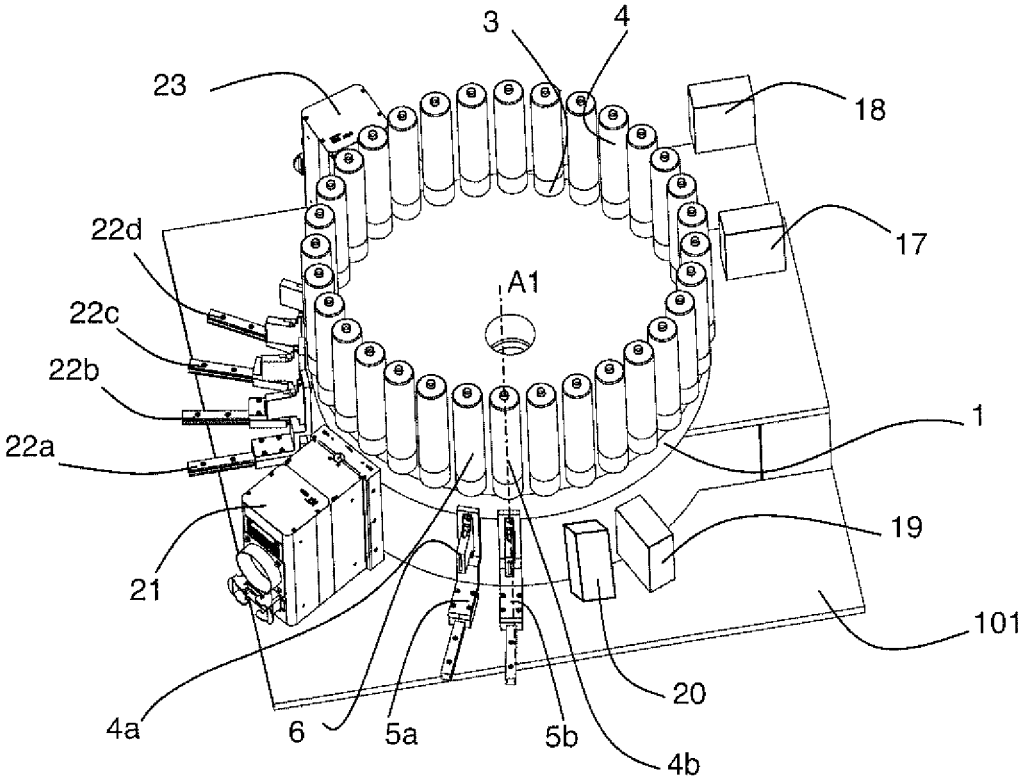
FIG. 1 illustrates a printing machine in a first printing position.

FIG. 1 shows an embodiment of a machine for printing on articles, which enables to ensure a high printing rate when printing on three-dimensional articles whose length may vary greatly.

Articles can have a generally cylindrical shape (e.g., flasks, bottles, pots, etc. . . . ). The shape of an article can slightly different from that of a cylinder; it can be slightly conical (e.g., cups), concave, or convex. It can also have an elliptical or oval section.

Cylinder refers to an object defined by a line called a generating line passing through a variable point along a closed plane curve, called a directrix curve and keeping a fixed direction.

Figure 2:
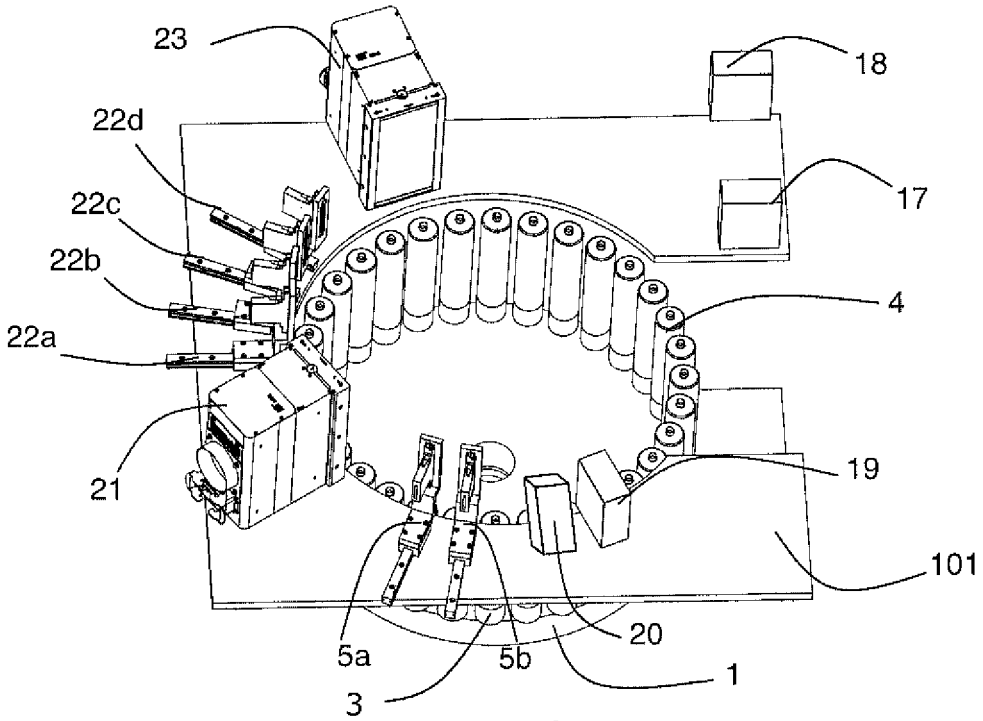
FIG. 2 illustrates a printing machine in a second printing position.
Figure 3:
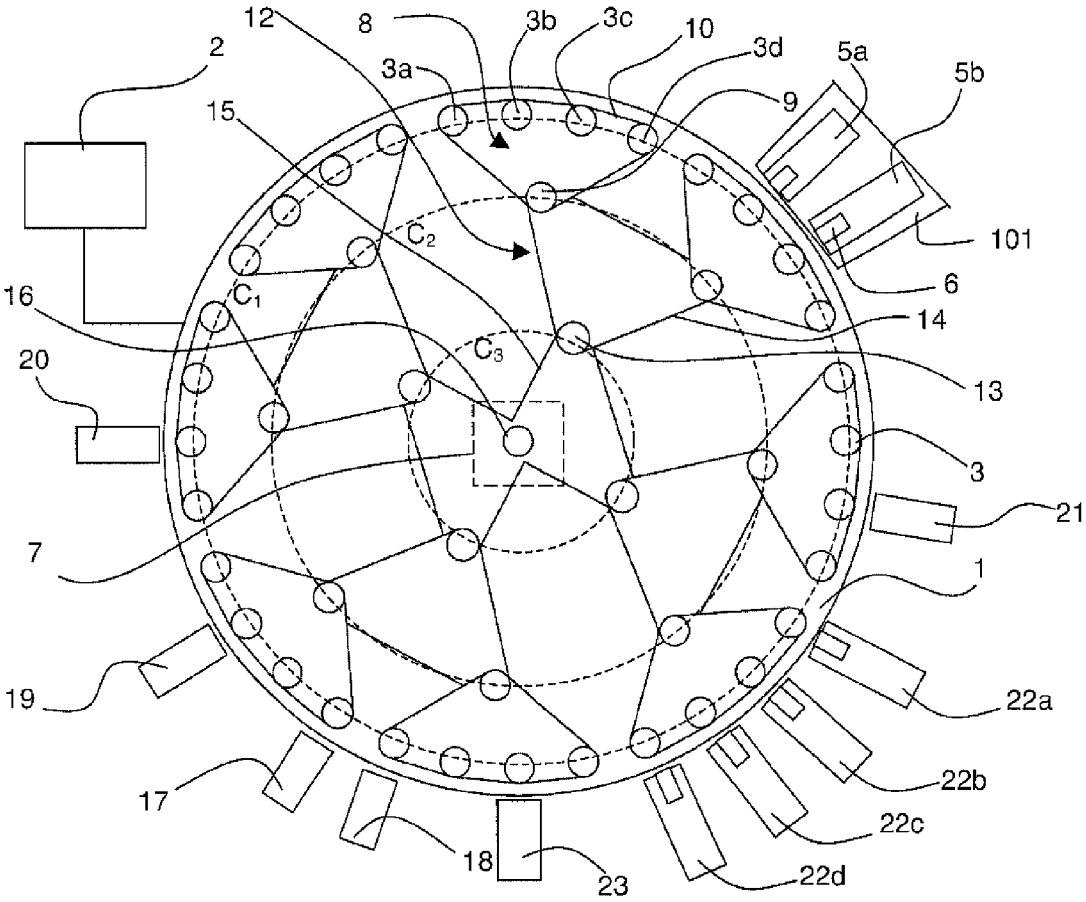
FIG. 3 shows a top view of a printing machine.

As illustrated in FIGS. 1 to 7, the printing machine comprises a support plate 1. This support plate 1 can be rotated by rotation means such as a motor 2 (FIG. 3) coupled to the plate support 1. The rotation of the support plate 1 enables to place it in different indexed positions for printing on or treating articles. The support plate 1 is provided on its periphery with a plurality of receiving elements 3 for articles 4. The receiving elements 3 can be uniformly distributed angularly around the periphery of the support plate 1 which preferably has the general form of a disk. In other words, as shown in FIG. 3, the receiving elements 3 are distributed along a circle $C_1$ at the same distance from the center of the support plate 1 coinciding with the center of the circle $C_1$. Each receiving element 3 is rotatably mounted on the support plate 1, for example by means of ball bearings. Of course, a person skilled in the art can use other types of rotating arrangement he/she knows. The rotation of a receiving element 3 enables to rotate an article 4 associated therewith. Preferably, the axis of rotation of the receiving elements 3 is substantially perpendicular, or exactly perpendicular, to the plane formed by the support plate 1. In the case of a disc-shaped support plate 1, the plane in question is that of the disc (plane P perpendicular to the plane of FIG. 4, the plane of the disc corresponding, in FIG. 3, to the plane of said FIG. 3).

In the present specification, substantially perpendicular means perpendicular to more or less 10 degrees.

Preferably, the receiving elements 3 are arranged so as to axially receive respective articles 4, an article 4 being associated with a receiving element 3 bearing it. 'Axially' means that the articles are arranged on the receiving elements with their longitudinal axis (A1 in FIG. 1) extending perpendicularly or substantially perpendicularly to the plane P of the support plate 1.

The receiving elements 3 are provided to ensure that the articles 4 are maintained in a stable and sufficiently precise manner during the various treatments. For example, in case the articles 4 are pot-shaped articles, the receiving elements 3 can have a shape molding the inside of the pots, the pots being arranged on the receiving elements 3 with their opening facing the support plate 1. In case the articles 4 are bottles, the receiving elements 3 can have a cylindrical shape having the diameter of the interior of the bottle necks. The receiving elements 3 can be equipped with an expansion system that enables to mold the internal shape of the necks. A center punch (not shown) bearing against the bottom of an article can be provided to perfect the axial alignment of the article.

In FIGS. 1 and 2, and applicable to the various embodiments described below, the means for rotating the support plate 1 are arranged so that two articles 4*a*, 4*b*, mounted on their associated receiving elements, respectively face (or are placed at) two separate printing stations 5*a*, 5*b* of the machine, each of them typically comprising a printing head 6. Both printing stations 5*a*, 5*b* are supported by the same base 101. Each printing station of the base 101 is preferably supplied with a single color, and preferably includes a single printing head. 'placed at' means that the receiving element 3 is proximal to the printing station 5*a*, 5*b* so that the surface of an associated article 4*a*, 4*b* can be printed by means of the printing head 6.

The two printing stations 5*a*, 5*b* are supported by the same base 101. Thus, the two printing stations 5*a*, 5*b* can be fixed to the base 101 by means of a total connection. 'Total connection' means that, once assembled, the printing stations 5*a*, 5*b* and the base 101 behave as a single piece and are located in a single referential system of movement. The example is not limited to a base associated with two printing stations, there may be more than two, each printing station being then associated with a separate article.

The machine further comprises means for generating a relative translational movement between the base 101 and the support plate 1. Advantageously, this movement can be constrained according to a vector between two points distributed along an axis substantially parallel to the axes A1 of rotation of the articles, so as to allow a helical printing process for patterns on the articles 4*a*, 4*b* associated with the stations 5*a*, 5*b*, during the rotation of the receiving elements 3. The receiving elements 3 can be rotated by means of a rotation system, e.g. a single motor. In other words, the means for generating the translational movement cooperate with the rotation system so as to allow the helical printing process.

In the particular example in FIGS. 1 and 2, the axes of rotation of the articles are perpendicular, or substantially perpendicular, to the plane of the support plate 1. The relative translational movement follows a direction parallel, or substantially parallel (more or less 10 degrees), to the axis of rotation of the articles 4. Thus, preferably, the base 101 is laterally shifted relative to the periphery of the support plate 1 in order to allow the passage thereof. In the case of a disc-shaped support plate 1, the base 101 is in a position in which it is arranged radially outside of the disc. In the example in FIGS. 1 and 2, the base 101 forms a perforated support plate so as to allow the passage of the support plate 1. The plane of the support plate 1 and the plane of the base 101 are preferably parallel (or substantially parallel) at any point during the relative translational movement between the base 101 and the support plate 1.

The helical printing process allows a single printing head to travel over the outer surface of an article in order to print a pattern thereon. For example, a 70 mm printing head can print a 140 mm long pattern on an article by causing the article to rotate three times on itself. Of course, the printing head will be, for example, controlled by a software capable of decomposing an image into a helical shape in order to print the pattern on the three-dimensional article. The software will be able, for example, to receive as an input, the image to be printed and a map of the outer surface of the article.

Placing at least two printing stations 5*a*, 5*b* on the same base provides a better reproducibility and superposition of the patterns helically printed at two stations, preferably immediately adjacent. In particular, the base 101 can comprise four printing stations, each of them being associated with a separate article for a particular position of the support plate 1. Each of the four printing stations can be associated with one color, respectively cyan, magenta, yellow and black. A given article will then pass successively through the four printing stations by using different indexed positions of the support plate 1. A printed pattern will be obtained by the superposition, the mixture or the juxtaposition of different colors, the reproducibility of the printing process must be at best carried out in a single pass in order to have the sensation that one defined pattern has been printed, when in fact it has been printed in several passes through separate printing stations. A several passes printing process has advantages in terms of production cost of the machine, easiness of implementation, and printing speed, that is why a printing station is preferably equipped with a single printing head supplied with a single color.

Therefore, by placing different printing stations on the same base 101 able to perform the same translational movement for each indexed position of the support plate 1, and by controlling the rotation speed of the receiving elements 3, 3*a*, 3*b*, 3*c*, it is possible to have a perfect reproducibility of the pattern printing process without any color shift for the same pattern. Advantageously, the machine comprises a speed controller able to measure the rotation speed of at least one or more receiving element(s) so as to control the printing stations in case the rotation speed varies and to avoid distortions in the printed pattern.

In such a machine, the support plate 1 can be fixed, the base 101 is then equipped with a motorization able to move it relative to the support plate 1. Alternatively, the base 101 can be fixed, and it is the support plate 1 that is equipped with a motorization able to move it relative to the base 101. If the support plate is fixed, it can be mounted on the machine frame through a total connection. If the base is fixed, it can be mounted on the machine frame through a total connection.

'Total connection between two elements' means that these two elements behave during their movements as a single piece.

Figure 6:
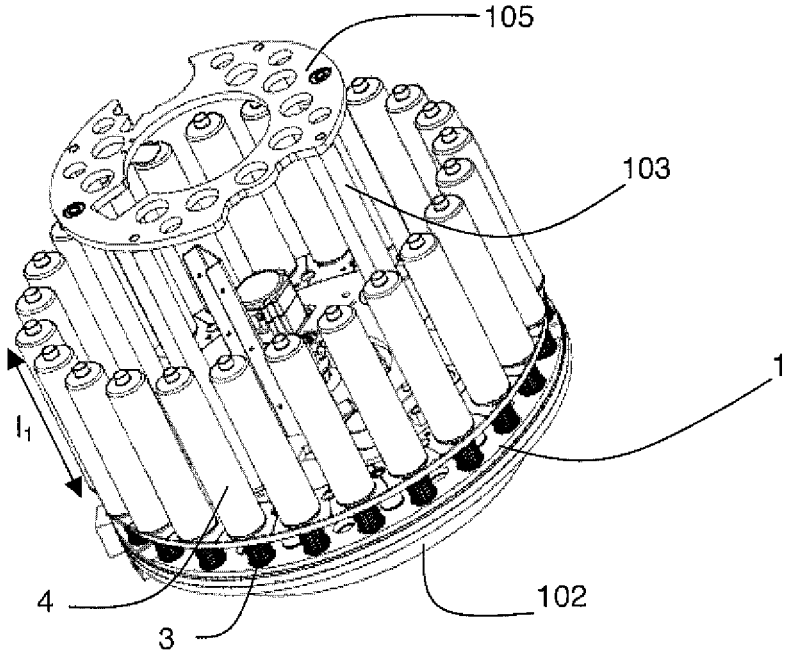
FIG. 6 illustrates a variant of the printing machine in a first position.
Figure 7:
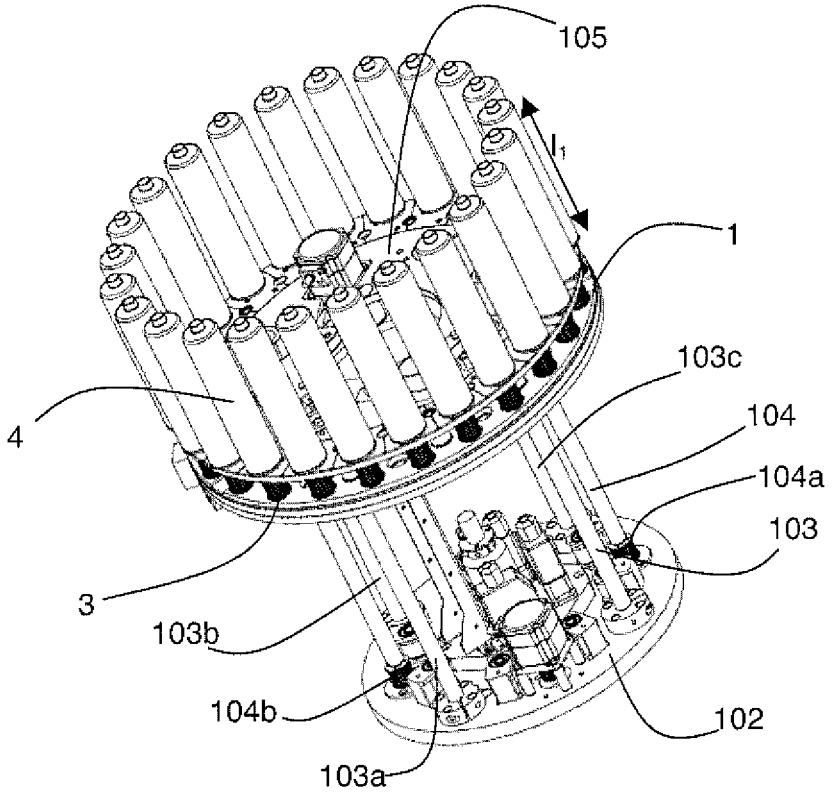
FIG. 7 illustrates a variant of the printing machine in a second position.

FIGS. 6 and 7 show a particular embodiment according to which it is the support plate 1 in its entirety that performs a translational movement with respect to the printing stations (not shown). In FIG. 6, the support plate 1 is in a first position, and in FIG. 7 the support plate 1 is in a second position. In order to achieve the translational movement, the means for generating the translation movement can comprise a support base 102 and a system 103 for guiding the translation movement of the support plate 1, said system 103 for guiding being mounted on the support base 102. Furthermore, the means for generating the movement can comprise a system 104 for moving the support plate 1 between a position of the support plate proximal to the support base 102, and a position of the support plate 1 distal to the support base 102 along the system for guiding. In FIG. 6, the proximal position corresponds to the first position, and in FIG. 7 the distal position corresponds to the second position. Although they are not shown, the printing stations can be supported by the same base and arranged adjacent to the assembly formed by the support plate and the support base in order to allow a helical printing during the movement of the support plate relative to its support base.

According to a particular embodiment, the system 103 for guiding can comprise at least one guidance rail in the form of an elongate rod fixed to the support base 102 and configured to slide in a complementary member of the support plate 1, said complementary member having advantageously a ball bearing system in contact with said rod. The ball bearing allows to limit the friction forces. In the particular example in FIGS. 6 and 7, the system for guiding comprises four guidance rails 103, 103*a*, 103*b*, 103*c* extending from the support base 102 to a flange 105, the travel of the support plate is then forced between the support base 102 and the flange 105 acting then advantageously as stops.

According to one embodiment, the system 104 for moving includes a helical connection. This helical connection can be implemented by a screw. A system for moving having two helical connections 104*a*, 104*b* can be seen in FIG. 7.

Advantageously, the system for rotating the receiving elements 3, 3*a*, 3*b*, 3*c* comprises a single motor (not shown) coupled to each receiving element via a single belt. Thus, each receiving element can comprise a pinion meshed with the belt.

In general, a method for printing on three-dimensional articles implements a support plate 1, provided on its periphery with a plurality of receiving elements 3 for articles 4. Such a support plate 1 can be of the type described above or in variants thereof described below. The method can then include a step wherein the support plate 1 and a base 101 provided with first and second printing stations 5*a*, 5*b* (or more) are placed in a first printing position in order that two separate articles respectively face the first and second printing stations 5*a*, 5*b*. The receiving elements 3 are rotated and the printing process for patterns, by means of the first and second printing stations 5*a*, 5*b* on the associated articles, is carried out as soon as the receiving elements 3 start to rotate or during the rotation thereof. As indicated above, the step of printing patterns on the articles 4 is carried out helically by imparting, during the rotation of the receiving elements 3, 3*a*, 3*b*, 3*c*, a relative translational movement between the support plate 1 and the base 101 up to a second printing position representative of the end of a printing cycle. The first and second printing positions are preferably placed at two shifted points along the rotational axes of the articles, and can correspond, where appropriate, to the stops formed by the support base 102 and the flange 105.

The rotation of the screw(s) of the system for moving according to a precise angle imposed by an associated motor will induce a precise displacement and a precise back movement to the origin.

The first and second printing positions are shown in FIGS. 1 and 2, as well as in FIGS. 6 and 7, the purpose being preferably to print a pattern on an article 4 over the entire length $l_1$ thereof.

In order to improve the time for treating the articles 4, once the second printing position is reached, the support plate 1 makes a rotation movement, during which a translational movement between the supporting plate 1 and the base 101 is initiated in order to take up again the relative level between the support plate 1 and the base 101 in the first printing position. Still during the rotational movement of the support plate, a single motor (not shown in FIGS. 1 and 2, but visible in FIG. 3 with the reference 7) rotates all the receiving elements 3 so that they take up again a position, relative to the support plate 1, identical to that in the first printing position. The rotational movement of the support plate allows to change its indexed position for treating the articles.

Preferentially, the result therefrom is that the rotational movement of the support plate 1, the translational movement and rotational movement of the receiving elements 3 overlap, all three, at least partially over time during the passage from the second position to the first position after a step of printing patterns. Thus, the resetting of the machine between two indexed positions of the support plate is carried out in masked time during said change of indexed positions. This allows to improve the printing rate.

In order to improve the reproducibility, in the case of a single belt meshed on the one hand with a single motor and on the other hand with each receiving element, at each return to the first position, the single belt takes up again an identical position.

Advantageously, the machine can include a control system configured to perform the steps of the method (movement control). This control system can also be connected to the speed controller described above in order to control the printing process.

Figure 4:
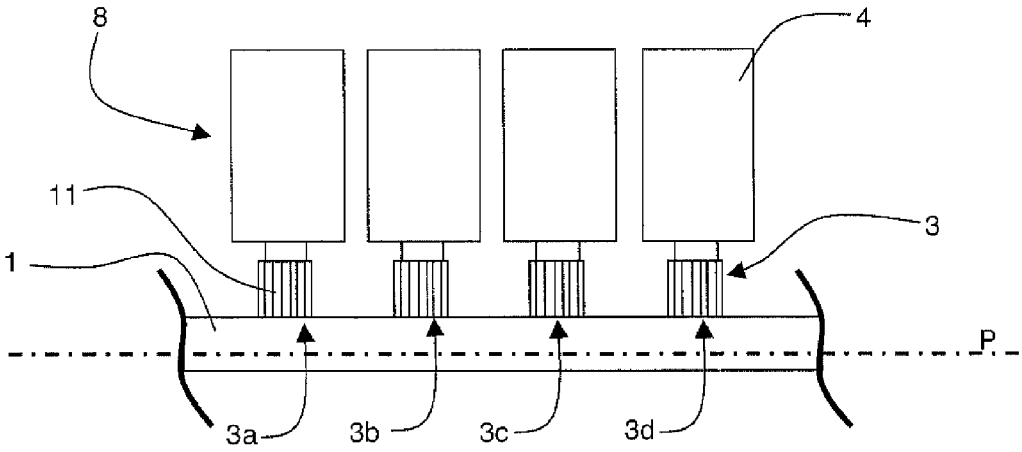
FIG. 4 illustrates a partial side view of the printing machine.
Figure 5:
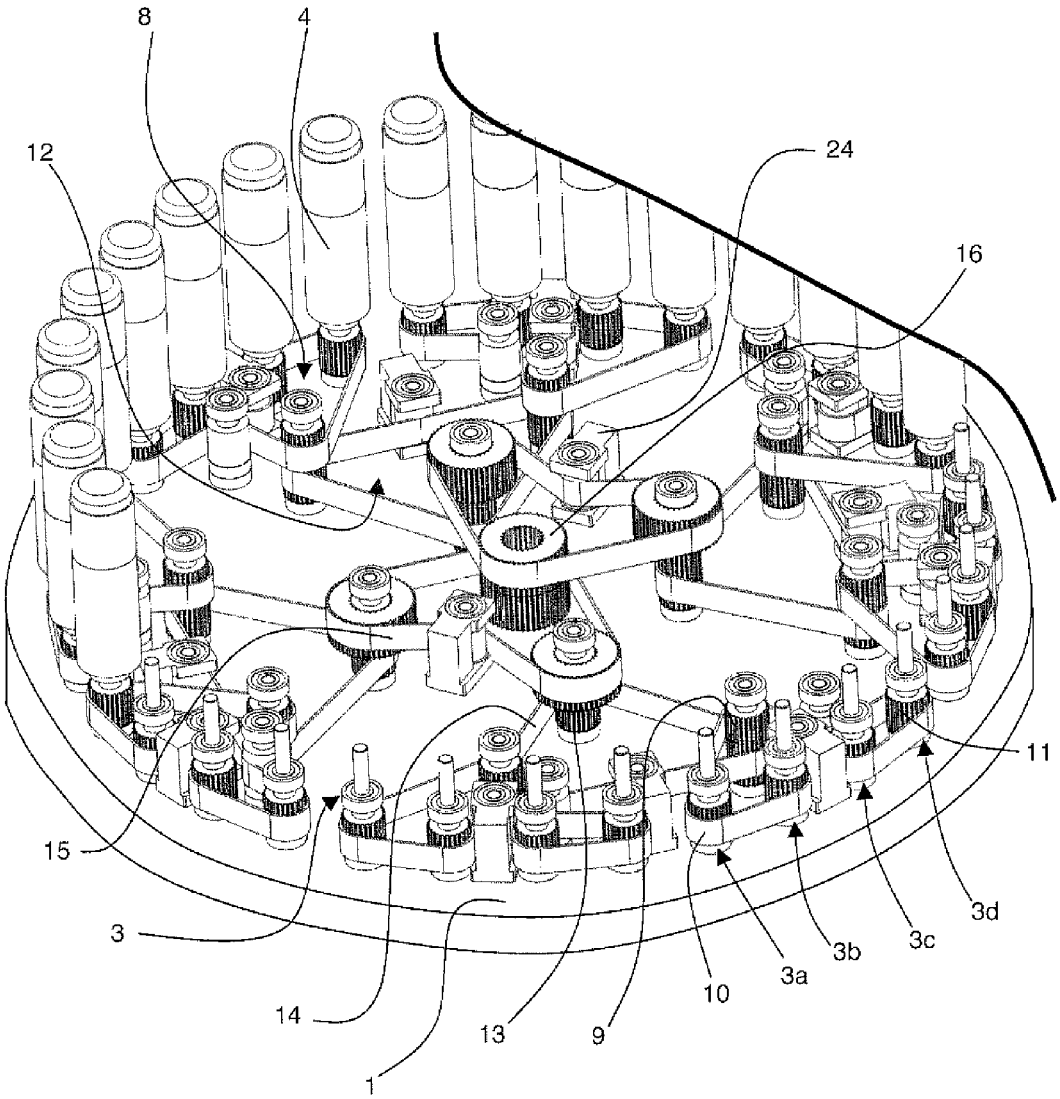
FIG. 5 illustrates a perspective view of the printing machine.

According to a preferred embodiment illustrated in FIGS. 3-5, and applicable to FIGS. 1-2, a single motor 7 is arranged so as to rotate all the receiving elements 3. The use of a single motor 7 provides a reproducible movement of the receiving elements 3 after each revolution of the latter, and a reproducibility of the patterns printed on each article.

This reproducibility ensures an equal treatment of the articles 4. In some above-mentioned cases, the articles 4 are treated by multiple printing heads, for different indexed positions of the support plate 1, different colors (e.g. white, black, magenta, cyan, yellow) so that the colors are superimposed in order to reproduce a pattern. During a full rotation of the receiving element 3 at a printing head, it is possible that some defects appear. For example, during its rotation, the motor can have some defects, leading to local and reproducible variation in the angular speed of a receiving element 3. It is preferable to reproduce the variation at each receiving element 3, and for each indexed position of the support plate 1, in order that similar defects overlap during the printing process so as not to be visible at first sight, and so as to obtain substantially identical printed articles, this is especially made possible by using the single motor 7.

According to a particular embodiment, the support plate 1 can comprise separate assemblies 8 distributed at the periphery of the support plate 1, and coupled to the single motor 7.

Each assembly 8 includes a series of receiving elements 3*a*, 3*b*, 3*c*, 3*d*, a first driving element 9 rotatably mounted on the support plate 1 and coupled to the single motor 7 (FIGS. 3 and 5). The first driving element 9 has, preferably, an axis of rotation substantially, or exactly, perpendicular to the support plate 1. Each assembly 8 further comprises an end transmission element 10 having the shape of a closed loop. The end transmission element 10 is secured to the receiving elements 3*a*, 3*b*, 3*c*, 3*d* of the series and to the first driving element 9 of the assembly concerned, which enables the simultaneous rotation of the first driving element 9, coupled to the single motor 7, and of the series of receiving elements 3*a*, 3*b*, 3*c*, 3*d*.

The division into assemblies particularly allows an easy connection to the motor 7 by limiting the number of transmission elements required, while maintaining a high printing rate. Furthermore, the return to the first printing position of the receiving elements is much faster without having to reverse the direction of rotation of the motor 7.

Preferably, the end transmission element 10 of each assembly 8 is arranged so that, after each revolution of the latter, the receiving elements 3*a*, 3*b*, 3*c*, 3*d* of the series, and the associated first driving element 9, take up again an identical position. This ensures for a given assembly the reproducibility of all the defects after each revolution of the end transmission element 10.

In order to improve the consistency between the assemblies and the printing rate, when an end transmission element 10 of an assembly 8 has made a revolution, all the end transmission elements 10 of different assemblies 8 preferably have made a revolution of the loop. In other words, after each revolution of an end transmission element 10, the receiving elements 3*a*, 3*b*, 3*c*, 3*d* of each series and the associated first driving elements 9 take up again an identical position.

'Identical position' means that the element concerned (first driving element, receiving element) has made at least one full revolution on itself (or an integer multiple of revolutions on itself), and is found in the same indexed position before starting its revolution. Thus, advantageously, the printing machine comprises a control system able to position, before, during or after each rotation of the support plate 1, the end transmission elements 10 in an identical position representative of the beginning of a revolution of said end transmission elements 10.

In FIGS. 4 and 5, for each assembly 8, each receiving element 3*a*, 3*b*, 3*c*, 3*d* preferably comprises a pinion 11 whose axis of rotation is preferably substantially or exactly perpendicular to the plane of the support plate 1. The first driving element 9 is a toothed wheel and the end transmission element 10 is a toothed belt whose number of teeth is an integer multiple of the number of teeth of each associated pinion 11, and of the number of teeth of the associated toothed wheel. Thus, the teeth of the toothed belt cooperate with the teeth of the toothed wheel and pinions 11. After each revolution of the toothed belt, a belt tooth comes back into contact with the same tooth of the toothed wheel, and other teeth of the toothed belt comes back into contact with the same associated teeth of the pinions.

Preferably, the assemblies 8 are connected in pairs in order to form separate unit elements 12. In each unit element 12, the first driving elements 9 of two assemblies joined together are connected to a second driving element 13, preferably rotatably mounted on the support plate 1, by means of an intermediate transmission element 14 having the shape of a closed loop, so that to each revolution of the intermediate transmission element 14 corresponds one revolution of the end transmission elements 10 of two assemblies connected. The second driving element 13 is coupled to the motor 7. The second driving element 13 takes up again an identical position after each revolution of the intermediate transmission element 14. Preferably, the second driving element 13 comprises a toothed wheel associated with the intermediate transmission element 14 which can be a toothed belt. The toothed wheel can comprise an axis of rotation substantially, or exactly, perpendicular to the plane of the support plate 1. Preferably, when the intermediate transmission element 14 makes one revolution of the loop, all the intermediate transmission elements 14 of the machine also make one revolution of the loop. The second driving element 13 has preferably an axis of rotation substantially, or exactly, perpendicular to the support plate 1.

In FIG. 3, the support plate 1 being preferably a disc, and the receiving elements 3 being arranged at the periphery of said disc according to a first circle $C_1$, the first driving elements 9 are preferably arranged according to a second circle $C_2$ concentric to the first circle and having a diameter inferior to that of the first circle $C_1$. Similarly, the second driving elements 13 are preferably arranged according to a third circle $C_3$ concentric to the second circle $C_2$ and having a diameter inferior to that of the second circle $C_2$. The centers of the first, second and third circles $C_1$, $C_2$, $C_3$ coincide with the center of the disc forming the support plate 1. In other words, starting from the periphery of the support plate, there are successively, towards the center of the support plate 1, the receiving elements 3, the first driving element 9, the second driving elements 13.

The coupling of the unit elements 12 to the motor 7 can be carried out by connecting them in pairs by means of a main transmission element 15, in the form of a closed loop, coupled on the one hand to a third driving element 16 fixed to a central axis driven by the single motor 7, preferably the central axis is a shaft of the single motor 7, and on the other hand to the second driving elements 13 of the unit elements 12 connected so that to each revolution of the main transmission element 15 corresponds a revolution or half a revolution of the intermediate transmission elements 14 of the connected unit elements 12 (and preferably of all the intermediate transmission elements). The third driving element 16 takes up again an identical position after each revolution of the main transmission element 15. Although the example concerned aims at one revolution or half a revolution, preferably to each revolution of an intermediate transmission element 14 corresponds an integer multiple of revolutions of the main transmission element 15. The third driving element 16 preferably has an axis of rotation substantially, or exactly, perpendicular to the support plate 1.

The main transmission element 15 can be formed by a toothed belt. The driving element 16 can comprise a toothed wheel whose axis of rotation is substantially, or exactly, perpendicular to the plane of the support plate 1.

As the transmission elements (end, intermediate and main) has the form of a closed loop, making a 'revolution' for these elements means making a revolution of the loop. The transmission elements can be in the form of belts, preferably toothed, or chains.

In order to enhance the reproducibility of the movements carried out by the receiving elements 3, it is preferred that the transmission elements (end, intermediate and main) can start from a first position of the transmission elements (associated with the first printing position), representative of the start of a revolution, in order to reach, according to a same first direction of rotation of the single motor 7, a second position of the transmission elements identical to the first position. Preferably, between the first and second positions of the transmission elements, the machine is passed through the second printing position. Between the first and the second position, the receiving elements 3 have made at least one complete revolution on themselves. In the first and second position, besides the transmission elements 10, 14, 15, all the driving elements 9, 13, 16 have preferably an identical position.

According to an improvement increasing the printing rate, after printing on an article, the control system is able to determine the current position of the transmission elements, preferably at least the end transmission element 10. Starting from the current position, and knowing the first position of the transmission elements, the control system determines the number of revolutions of the motor shaft in the first direction of rotation of the single motor 7 needed to reach the second position of the transmission elements, it also determines the number of revolutions of the motor shaft for coming back in the first position of the transmission elements by reversing the direction of rotation of the single motor 7 in a second direction of rotation. The control system selects the less demanding solution in terms of revolutions of the motor shaft for the receiving elements 3 to take up again an identical position. After the printing process, as the rotation speed of the receiving elements no longer need to be compatible with a printing speed of the printing head, the speed of the single motor 7 can rise (whatever the direction of rotation).

According to the particular example in FIGS. 3-5, the printing machine comprises eight assemblies angularly distributed at the periphery of the support plate 1, and four separate unit elements 12. Each assembly comprises four receiving elements 3*a*, 3*b*, 3*c*, 3*d*. Each receiving element 3*a*, 3*b*, 3*c*, 3*d* is provided with a pinion 11 having twenty-five teeth, and the first driving element 9 of an assembly is formed by a toothed wheel having twenty-five teeth. The associated end transmission element 10 is a toothed belt having one hundred and fifty teeth. In other words, when the toothed belt of an assembly makes one revolution, all the receiving elements 3, and all the first driving elements 9, make exactly six revolutions on themselves. This allows, as mentioned above, to avoid mismatches and to correct the possible defects after every six revolutions of the receiving elements 3.

The first driving elements 9 of two adjacent assemblies are coupled to a second driving element 13 in order to form a unit element 12. In FIG. 5, as a matter of fact, the second driving element 13 comprises two toothed wheels whose axis of rotation is preferably perpendicular to the support plate 1. These two toothed wheels are interconnected by means of a total connection, that is to say, they are fixed relative to each other, they thus have a same angular speed. A first wheel having twenty-five teeth of the second driving element 13 is coupled to the intermediate transmission element 14 formed by a toothed belt having one hundred and fifty teeth. A total of four unit elements 12 is then obtained.

Finally, the four unit elements are coupled in pairs to the central axis. Each coupling process can be performed by means of a main driving element 15, having the form of a toothed belt with one hundred and fifty teeth, coupled on the one hand to second wheels with fifty teeth of the second driving elements 13 respectively of the two connected unit elements, and to a third driving element 16 preferably arranged in the form of at least one toothed wheel with fifty teeth attached to the central axis. In FIG. 5, there are only two toothed belts forming the main transmission elements 15.

According to the example, the toothed belts forming the end, intermediate and main transmission elements are all identical.

In fact, in the example in FIG. 5, when the belts forming the end transmission elements 10 make one revolution, the belts forming the intermediate transmission elements 14 make one revolution, and the belts forming the main transmission elements 15 make two revolutions. In the example, wheels with fifty teeth (second wheels and third driving element) are used together with an axis or a motor shaft with a large diameter. In the application, if the axis, or the motor shaft, allows it, the person skilled in the art can also use, at the second driving element 13, second wheels with twenty-five teeth (which could be mistaken for the first wheels) and a third driving element 16 with twenty-five teeth, one revolution of the main transmission element 15 will thus cause one revolution of the intermediate transmission element 14.

This ensures at best the reproducibility of rotational movements of an article on its receiving element for each indexed position of the support plate.

Alternatively, it is possible to free oneself from conditions on the number of teeth since the single motor 7 is able to rotate all the receiving elements 3. To this end, the control system detects a first position of the receiving elements 3 representative of the beginning of a treatment of articles, for example a printing process for articles. All the receiving elements 3 are rotated in a first direction of rotation of the single motor 7. When the treatment of the articles is over for a given indexed position of the support plate, the receiving elements take up again a second position, the direction of rotation of the single motor is then reversed in order to bring the receiving elements back to the first position. The receiving elements can be brought back into the first position before, after or during the rotation of the support plate 1 in order to improve the printing rate.

In general, the above-described control system can be implemented by means of an electronic equipment provided with a program able to determine, from the state of the motor and the components of the machine, a picture of each moment of the operation of said machine. According to this picture, the control system can easily make the receiving elements return to an identical position.

Preferably, the single motor 7 making the receiving elements 3 rotate in this embodiment, or in the embodiment with a single motor and a single belt, is a motor of the type 'brushless motor'. Such a motor avoids the fluctuations of the electrical and mechanical losses relating to other types of motors, the consequences of which would be the introduction of non-reproducible shifts after each revolution of the end transmission, intermediate transmission and main transmission elements. In addition, the use of a brushless motor allows to know the exact position of the receiving elements 3 and transmission elements, which facilitates the work of the above-described control system. According to the particular example with the fixed number of teeth and the use of belts with one hundred and fifty teeth, we know that after every six revolutions of the central axis we are again in a known position from which all the possible shifts are reproduced identically.

In general, according to a particular implementation of the printing machine whose support plate 1 is preferably a disc, treatment stations for articles, e.g. printing heads, are distributed radially around the support plate 1, preferably regularly and are preferably fixed on a same base 101. The printing heads, equipping the printing stations, can be distributed with an angle relative to the center of the disk equal to the angle between two adjacent receiving elements 3 or a multiple of this angle. When one of the heads faces a receiving element provided with an associated article, this allows to place the other heads respectively opposite other articles, and the articles can thus be concurrently treated in order to increase the printing rate of the printing machine. In other words, when a receiving element faces a treatment station, other treatment stations also face an associated receiving element, in order to treat an associated article. An article can then be subjected to different treatments for different indexed positions of the support plate 1.

As in the example in FIGS. 1-3, the support plate 1 can be arranged so as to transport each article from a loading station 17 to an unloading station 18. The loading station 17 can be equipped with a gripper arm able to grip an article in a first working position, and to insert the article gripped with a receiving element 3 proximal to the loading station 17 in a second working position. Similarly, the unloading station 18 can be adjacent to the loading station 17, and can comprise a working position in which an associated gripper arm can retrieve the article attached to the receiving element facing the unloading station 18. On the path traveled by an article fixed to the support plate 1 via its associated receiving element 3, in the clockwise direction according to the example, between the loading station 17 and the unloading station 18, are arranged various treatment stations distributed radially around the support plate 1.

Among the treatment stations one can find successively, starting from the loading station, an anti-static treatment station 19, a surface treatment station 20 (of the type corona, flame or plasma), a printing station 5, 5*a* 5*b* equipped with a white ink, an ultraviolet-radiation drying station 21, color printing stations, and another ultraviolet-radiation drying station 23. Preferably, there are four color printing stations, each of them comprising a printing head 22*a*, 22*b*, 22*c*, 22*d* respectively associated with the black, cyan, magenta and yellow colors (regardless of the distribution).

When the printing machine is running, the print heads are orientated towards the article proximal to the printing station concerned. Preferably, each head has an independent inclination adjustment relative to the vertical of the support plate so as to follow the profile of an article, especially when the latter is conical. The nozzles of each printing head are preferably perpendicular to the plane of the support plate 1. Preferably, the color printing stations are adjacent so that, for each indexed position of the support plate 1, an article successively moves from one printing station to another so that the mixture of inks is obtained under optimal conditions. The white-color printing station 5 can be separated from the black-, magenta-, cyan- and yellow-color printing stations 22*a*, 22*b*, 22*c*, 22*d* by a drying station 21. The white-color printing station 5 in fact allows to cover the article with a white underlayer when the articles are dark. Although this is not shown, between each color printing station, it is possible to insert a drying station for the printed ink.

A drying station can be an ultraviolet-based one using light emitting diodes as a source of ultraviolet light so as to solidify the ink droplets printed on the articles.

Preferably, when a treatment station is in a working position in which it is able to treat an article, the other stations are also in a working position.

The above-described printing machine allows to obtain a high printing rate.

In FIG. 5, each belt is preferably associated with at least one tension device 24 able to adjust the tension of the associated belt.

One of the particular examples described above aims at a machine including eight assemblies, however, the person skilled in the art will be able to adapt the machine according to the diameter of the disc forming the support plate. Thus, the machine may comprise more than eight assemblies, the number of assemblies will preferably be a number to the power of two, superior or equal to eight. Two adjacent assemblies may form a separate unit element, then the separate unit elements may recursively merge in pairs up to obtain four separate unit elements, each of them having a driving element proximal to the central axis, and connected in pairs to the third driving element via an associated main transmission element.

According to the embodiment of the support plate in FIGS. 3 and 5, during the printing process implementing a printing machine as described above, the first printing position can be associated with a position wherein the end transmission elements 10 are at an indexed position representative of the beginning of a revolution of the end transmission elements 10. Then, at least one complete revolution of each receiving element (3, 3*a*, 3*b*, 3*c*, 3*d*) is carried out, during this rotation all the articles or at least part of them are treated. Then, the end transmission elements 10 are replaced into the indexed position representative of the beginning of a revolution of these elements (back to the first printing position). This allows to ensure that all the reproducible defects will be reproduced identically for each indexed position of the support plate 1. Thus, before, after or preferably during the step in which the end transmission elements 10 take up again the indexed position representative of the beginning of a revolution of the end transmission elements 10, the support plate 1 makes a rotational movement on itself in order to move an article from a first treatment station to a second treatment station.

Preferably, the complete rotation of each receiving element 3, 3*a*, 3*b*, 3*c*, 3*d* is carried out in a first direction of rotation of the single motor 7, and the indexed position representative of the beginning of a revolution of the end transmission elements 10 is taken up again by rotating the single motor 7 in a second direction of rotation, reversed with respect to the first direction.

In fact, when the rotation of the single motor is reversed, the direction of rotation of the shaft of the motor driving the receiving elements is reversed, this inversion is then transmitted to the receiving elements.

The single motor 7 allows to rotate the articles at a speed compatible with the printing speed of the printing heads.

Preferably, the single motor allows to rotate all the receiving elements at an identical angular speed. This allows in particular to improve the printing rate ensuring that, when a receiving element has made a revolution on itself, all the receiving elements have also made a revolution on themselves. Thus, all the receiving elements are preferably rotated simultaneously, and are not disengageable from each other in order to allow a same angular displacement in the same rotational speed.

In case the articles have not a circular section, they will be arranged in the same way on each receiving element in order that the evolution profile of the article relative to the rotational position is the same and is known by a print management software.

According to a variant not shown, the single motor may be coupled to a ring toothed on its outer periphery with each pinion of each receiving element. In this case, each time the first printing position is taken up again, the ring and the pinions take up again an identical position.

The invention claimed is:

1. Printing machine comprising:

a support plate provided on its periphery with a plurality of receiving elements for articles rotatably mounted on the support plate, means for rotating the support plate in order that two articles, mounted on their associated receiving elements, respectively face two separate printing stations of the machine, a system for rotating the receiving elements, a base supporting the two printing stations, and means for generating a relative translational movement between the base and the support plate, and for cooperating with the system for rotating so that patterns are helically printed on articles associated with the two printing stations.

2. Machine according to claim 1, wherein each printing station of the base is supplied with a single color.

3. Machine according to claim 1, wherein the means for generating the translational movement comprise:

a support base, a system for guiding the translational movement of the support plate, said system for guiding being mounted on the support base, and a system for moving the support plate between a position of the support plate proximal to the support base, and a position of the support plate distal to the base support along the system for guiding.

4. Machine according to claim 3, wherein the system for guiding comprises:

at least one guidance rail in the form of an elongate rod fixed to the support base and configured to slide in a complementary member of the support plate, said complementary member comprising a ball bearing system in contact with said rod.

5. Machine according to claim 3, wherein the system for moving includes a helical connection.

6. Machine according to claim 5, wherein the helical connection is implemented by a screw.

7. Machine according to claim 1, wherein the system for rotating the receiving elements comprises a single motor coupled to each receiving element via a single belt.

8. Method for printing on three-dimensional articles implementing a support plate provided on its periphery with a plurality of receiving elements for articles, said method comprising the following steps of:

placing the support plate, and a base provided with first and second printing stations, into a first printing position so that two different articles respectively face the first and second printing stations, rotating the receiving elements, and printing, by means of the first and second printing stations, patterns on the associated articles, the step of printing patterns on the articles being helically performed by imparting, during the rotation of the receiving elements, a relative translational movement between the support plate and the base up to a second printing position representative of the end of a print cycle.

9. A printing method according to claim 8, wherein, once the second printing position is reached, the support plate carries out a rotational movement during which:

a translational movement between the support plate and the base is initiated so as to take up again the relative level between the support plate and the base in the first position, and a single motor rotates all the receiving elements so that they take up again a position, relative to the support plate, identical to that in the first printing position.

10. A printing method according to claim 9, wherein the rotational movement of the support plate, the translational movement and rotational movement of the receiving elements overlap at least partially over time during the passage from the second printing position to the first printing position after a step of printing patterns.

* * * * *